United States Patent [19]

Deguchi

[11] 4,354,374

[45] Oct. 19, 1982

[54] BENDING PRESS

[75] Inventor: Hideaki Deguchi, Komatsu, Japan

[73] Assignee: Kabushiki Kaisha Komatsu Seisakusho, Tokyo, Japan

[21] Appl. No.: 216,784

[22] Filed: Dec. 16, 1980

[30] Foreign Application Priority Data

Dec. 24, 1979 [JP] Japan ..... 54-177711[U]

[51] Int. Cl.[3] ..... B21D 7/06

[52] U.S. Cl. ..... 72/389; 72/448; 72/462

[58] Field of Search ..... 72/389, 386, 380, 446, 72/448, 462

[56] References Cited

U.S. PATENT DOCUMENTS

| | | | |
|---|---|---|---|
| 1,305,973 | 6/1919 | Pearne | 72/448 |
| 3,327,515 | 6/1967 | Beyeler | 72/389 |
| 3,587,286 | 6/1971 | Fritsch | 72/448 |
| 3,965,721 | 6/1976 | Roch | 72/389 |
| 4,016,742 | 4/1977 | Shiokawa | 72/389 |
| 4,294,095 | 10/1981 | Kawano | 72/389 |

FOREIGN PATENT DOCUMENTS

| | | | |
|---|---|---|---|
| 616783 | 8/1935 | Fed. Rep. of Germany | 72/389 |
| 45-14753 | 5/1970 | Japan . | |

*Primary Examiner*—Gene Crosby

*Attorney, Agent, or Firm*—Armstrong, Nikaido, Marmelstein & Kubovcik

[57] ABSTRACT

A press for bending a sheet metal comprising a support member fixedly secured to a press frame, a slide vertically movable on the press frame toward and away from the support member, a punch secured to the slide, a table mounted on the support member, a die secured to the table, and a plurality of adjusting wedge mechanisms disposed between the support member and the table. An upper wedge member is fixedly secured to the table, and a lower wedge member is laterally movable relative to the support member. A rack is fixedly secured to the lower wedge member, and a pinion engageable with the rack for vertical adjustment of each adjusting mechanism.

1 Claim, 4 Drawing Figures

BENDING PRESS

BACKGROUND OF THE INVENTION

This invention relates to a bending press or press brake comprising a horizontally long fixed apron, a horizontally long slide adapted to move upwards and downwards relative to the apron, a die fixedly secured to the upper part of the fixed apron, a punch fixedly secured to the lower part of the slide, and cylinder means adapted to urge the punch on the die through the slide thereby bending a workpiece inserted between the punch and the die, and more particularly to an apparatus for compensating the depth of penetration of the punch into the die during bending work.

In general, the bending press is provided with a V-shaped die secured onto the fixed apron and a punch fitted to the slide, and a workpiece subjected to bending work is disposed on the die. When the punch and the slide are lowered by working means, the punch will contact with the workpiece and then move into the die so as to commence bending of the workpiece. The slide is moved further downward to its lower stop position so as to complete the bending work. The bending angle of the workpiece is determined by the width of the V-shaped groove of the die and the depth of penetration of the punch. The aforementioned depth of penetration is determined not only by the lower stop position of the slide, but is also affected by the straight condition of the fixed apron and the slide, the height of the punch, the depth of the groove of the die and deformations of the apron and the slide during bending work etc,.

In the bending press, the downwardly urging force of cylinder means in the form of a concentrated load is exerted on the slide, whilst the fixed apron is supported at both ends thereof. In contrast thereto, during the bending work, the workpiece will exert a uniformly distributed reaction force along the length of the bending work on the fixed apron and the slide. Consequently, the apron and the slide will be subjected to an elastic deformation, respectively. Such deformations depend on the length of bending and the pressurizing force necessary for bending the workpiece.

For example, in bending presses provided with cylinder means mounted on the left and right hand ends of the slide, the punch may have a maximum strain $\delta$ at the middle point between the pressurizing points of the left and right hand cylinder means. Further, the die may have a maximum strain $\delta'$, in the like manner.

However, the strains $\delta$ and $\delta'$ are maximum values which will be continuously reduced towards the pressurizing points of the cylinder means. As is known to those skilled in the art, it is almost impossible to finish the fixed apron and the slide completely straight.

Mutual complex interferences of the above-mentioned factors may result in changes in the depth of penetration of the punch into the die and hence changes in the bending angle of the finished workpiece. In most cases, the depth of penetration may become minimum near the central part of the fixed apron and the slide, and may be maximum in the vicinity of the pressurizing points of the cylinder means. Stating in more detail, at locations close to the central part, the depth of penetration of the punch into the die is shallow, whilst the bending angle may become comparatively large. While, at the extreme ends, the depth of penetration may become deep, whilst the bending angle may become smaller than that of the central part. Therefore, the central parts of the fixed apron and the slide tend to open giving a large adverse effect on the accuracy of bending of finished article.

In order to eliminate this problem, there has heretofore been employed a method which comprises connecting the punch and the slide by means of a plurality of connector means, each connector means being provided with a wedged key, and adjusting the space interval between the punch and the slide by moving the wedged keys transversely so as to project the punch downwards by the strain $\delta$ thereof. However, such method requires in practice a considerable time and skill and the adjustment itself is considerably difficult to carry out.

SUMMARY OF THE INVENTION

It is therefore an object of the present invention to provide a bending press for bending a sheet metal which overcomes the above noted problems.

Another object of the present invention is to provide a sheet metal bending press which is provided with a plurality of die height adjusting means each including a rack and pinion mechanism in order to facilitate adjustments. In accordance with an aspect of the present invention, there is provided a press for bending a sheet metal, comprising: a frame of said press; a stationary first support member fixedly secured to said frame; a second support member vertically movable on said frame toward and away from said first support member; a punch secured to said second support member; a table mounted on said first support member; a die secured to said table; and a plurality of adjusting means disposed between said first support member and said table for adjusting the height of said table, each of said adjusting means comprising a first wedged member fixedly secured to said table and a second wedged member laterally movable relative to said first support member, said first and second wedged members being arranged one upon the other.

The above and other objects, features and advantages of the present invention will be readily apparent from the following description taken in conjunction with the accompanying drawings.

DESCRIPTION OF THE PREFERRED EMBODIMENT

The present invention will now be described in detail below by way of example only with reference to the accompanying drawings.

Figure 1:
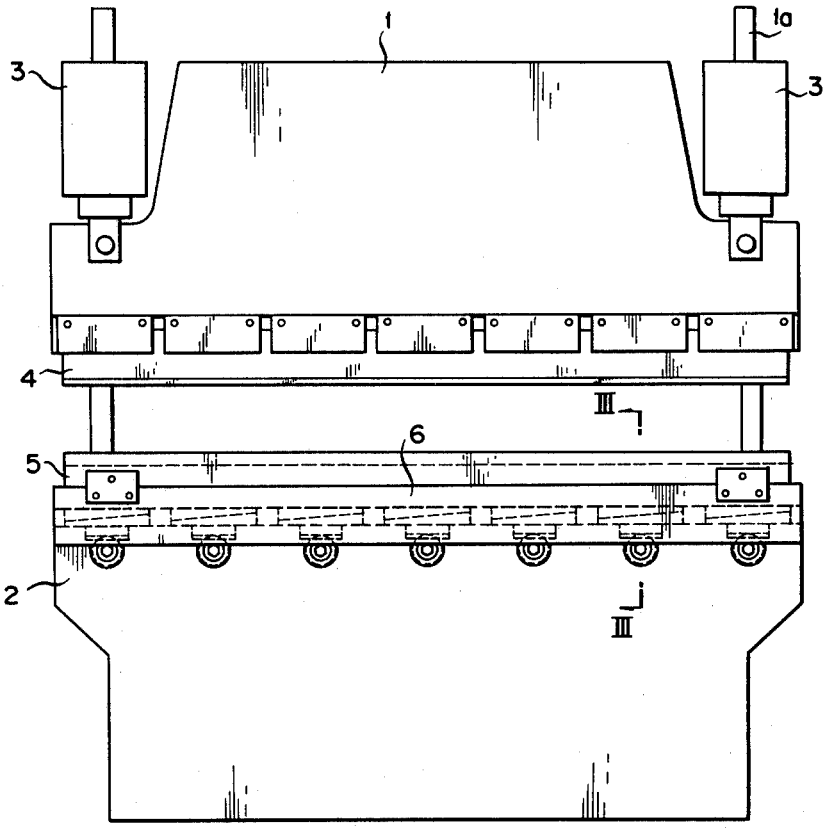
FIG. 1 is a front elevation of a bending press according to the present invention.
Figure 2:
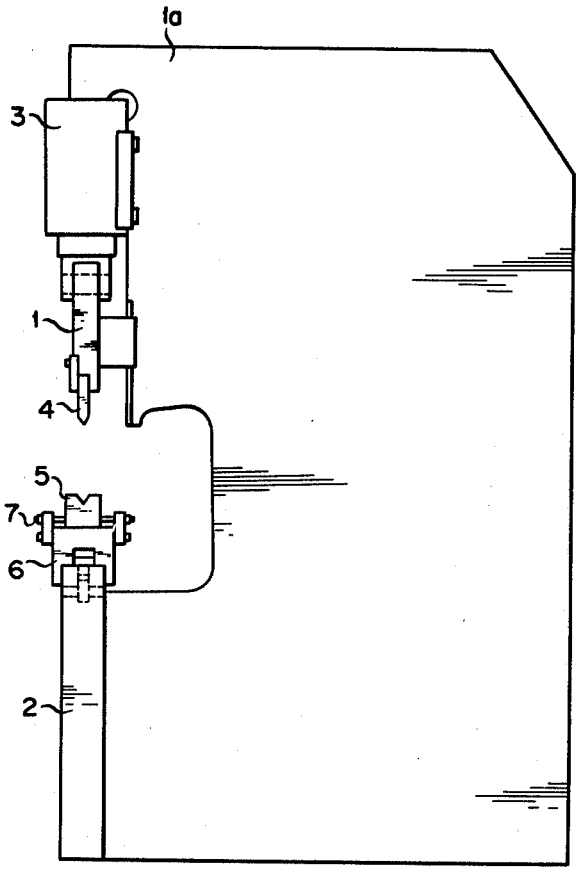
FIG. 2 is a side elevation thereof.

FIGS. 1 and 2 are plan view and side elevational view of a bending press, respectively, in which a punch 4 is fitted to a slide 1. Mounted on both side portions of a press frame 1*a* are cylinder means 3 each adapted to drive the slide 1 vertically. A die 5 is positioned and fixedly secured on a table 6 by means of bolts 7. The table 6 is secured on an fixed apron 2 by means of bolts 18. Inserted between the table 6 and the fixed apron 2 are pairs of wedges. One wedge 16 of each pair of wedges is fixedly secured on the table 6, whilst the other wedge 15 thereof has a rack 13 fitted thereto. With moving the rack 13 to the left and to the right by means of a pinion 11, the strain of the slide and the apron during bending work can be compensated.

Figure 3:
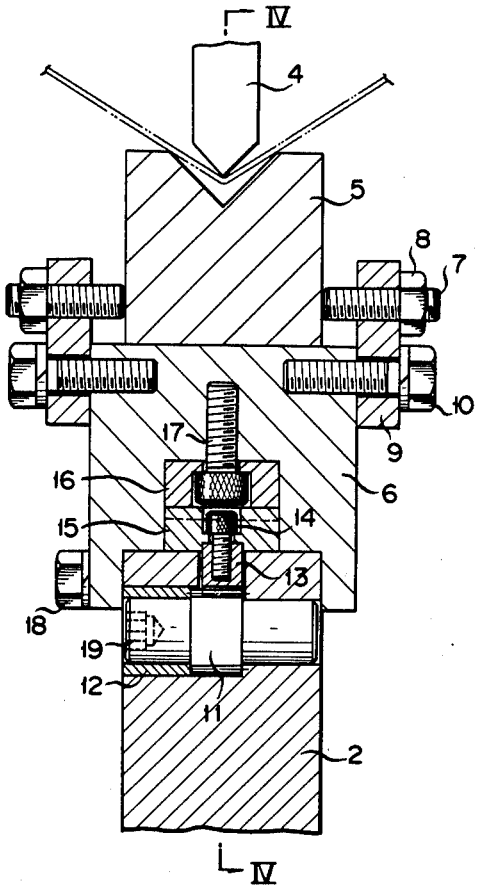
FIG. 3 is a cross-sectional view taken along the line III—III of FIG. 1.
Figure 4:
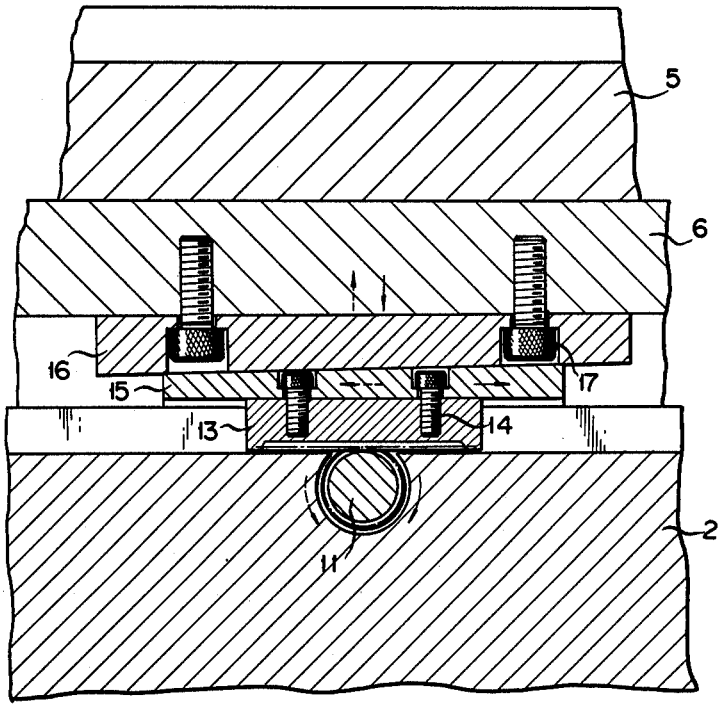
FIG. 4 is a cross-sectional view taken along the line IV—IV of FIG. 3.

The wedge members will be described in detail below with reference to FIGS. 3 and 4.

Four plates 9 are fitted to the table 6 by means of bolts 10, and which plates secure the die 5 fixedly on the table 6 by means of screws 7 and nuts 8 and also align the die 5 with the punch 4. The table 6 is fitted to the fixed apron 2 by means of bolts 18. The table 6 has a longitudinally extending groove formed in the central part thereof. A plurality of upper wedges 16 are fixedly secured by means of bolts 17 within the groove, whilst corresponding freely slidable lower wedges 15 are inserted within the groove. Each lower wedge 15 has a rack 13 fixedly secured thereto by means of bolts 14. The fixed apron 2 has a longitudinally extending groove formed in the upper surface thereof, and also has a hole formed therein for accommodating a pinion 11 and a bush 12. The pinion 11 is freely rotatable and can be rotated by means of a wrench adapted to be inserted into a hexagonal hole 19, which is formed on an end face of the apron 2.

Thus, when the pinion 11 is rotated clockwise by turning the wrench, the associated lower wedge 15 may be moved together with the rack 13 to the right hand. Both the wedges 15 and 16 have rightwardly raised slopes, and therefore a clearance may be created between the sliding surfaces of the wedges 15 and 16 with the rightward movement of the lower wedge 15. Reversely, when the pinion 11 is rotated counterclockwise, the associated lower wedge 15 may be moved to the left to push the upper wedge 16 upwardly. In this case, a clearance may be created between the table 6 and the fixed apron 2. The pinion has at its end face a radially graduated scale so that the amount of vertical movement of the wedge and the present figure thereof can be read out thereby.

The arrangement of the present invention described hereinabove has the following advantages.

(1) Adjustments can be made only by rotating the pinions clockwise or counterclockwise, and so the adjusting time can be reduced and even unskilled person can make adjustments readily.

(2) In general, the bending work of long articles has been made by using several kinds of short punches in combination in connection with the common use of punches and the diversification of the bending work. In case of the arrangement in which the punches are connected to the slide by means of connector means, the connector means has stepwise unevenness which, when divided punches are fitted thereto, tends to create a difference in height in the joints of the divided punches thereby giving a bad influence on the work. However, according to the present invention, the punch is fitted directly to the slide or the attachment of the punch is made by means of a plurality of connector means having the same height, and therefore there is no possibility of the occurrence of such problem.

It is to be understood that the foregoing description is merely illustrative of a preferred embodiment of the present invention, and that the scope of the invention is not to be limited thereto, but is to be determined by the scope of the appended claims.

What I claim is:

1. A press for bending a sheet metal, comprising:

a frame of said press;

a stationary first support member fixedly secured to said frame;

a second support member vertically movable on said frame toward and away from said first support member;

a punch secured to said second support member;

a table mounted on said first support member;

a die secured to said table; and a plurality of adjusting means disposed between said first support member and said table for adjusting the height of said table, each of said adjusting means comprising a first wedged member fixedly secured to said table, a second wedged member laterally movable relative to said first support member, said first and second wedged members being arranged one upon the other, a rack fixedly secured to said second wedged member and a pinion engageable with said rack, said pinion having means formed therein open to the front face of said first support member for receiving a tool for turning said means.

* * * * *